United States Patent [19]

Wes et al.

[11] 4,424,944

[45] Jan. 10, 1984

[54] DEVICE TO SPATIALLY ENCODE A BEAM OF LIGHT

[75] Inventors: James A. Wes, Diamond Bar; Raymond H. Ottoson, Garden Grove, both of Calif.

[73] Assignee: Northrop Corporation, Hawthorne, Calif.

[21] Appl. No.: 444,643

[22] Filed: Nov. 26, 1982

Related U.S. Application Data

[63] Continuation of Ser. No. 119,473, Feb. 7, 1980, abandoned.

[51] Int. Cl.[3] ..... F41G 7/26

[52] U.S. Cl. ..... 249/3.13

[58] Field of Search ..... 244/3.13, 3.16, 3.17; 250/203 R

[56] References Cited

U.S. PATENT DOCUMENTS

| | | | |
|---|---|---|---|
| 3,239,674 | 3/1966 | Aroyan et al. | 244/3.16 |
| 3,323,757 | 6/1967 | Cole | 244/3.16 |
| 3,367,607 | 2/1968 | Bowen | 244/3.16 |
| 3,711,046 | 1/1973 | Barhydt et al. | 244/3.16 |
| 3,794,272 | 2/1974 | Hecker | 244/3.17 |
| 4,014,482 | 3/1977 | Esker et al. | 244/3.13 |
| 4,056,720 | 11/1977 | Williams, Jr. et al. | 244/3.16 |
| 4,149,686 | 4/1979 | Stauff et al. | 244/3.13 |
| 4,174,818 | 11/1979 | Glenn | 244/3.13 |
| 4,195,799 | 4/1980 | Sogo et al. | 244/3.16 |

FOREIGN PATENT DOCUMENTS

| | | | |
|---|---|---|---|
| 1269508 | 8/1959 | Fed. Rep. of Germany | 244/3.16 |

*Primary Examiner*—Charles T. Jordan

*Attorney, Agent, or Firm*—Robert J. Stern; John E. Peele, Jr.

[57] ABSTRACT

A guidance system for a beam rider missile, having a novel coded light beam projector at an aiming station, for use by a missile-mounted receiver. The projecting means contains a rotating transparent reticle through which the beam is transmitted, the reticle having an opaque radial portion in a curved "leaf" shape. When the diameter of the projected beam is held constant at the missile distance during flight, the position of the missile in polar coordinate form is given by the relative angular position and duration of the blocked-out portion of the beam received at the missile.

16 Claims, 7 Drawing Figures

DEVICE TO SPATIALLY ENCODE A BEAM OF LIGHT

This application is a continuation of application Ser. No. 119,473, filed Feb. 7, 1980, now abandoned.

BACKGROUND OF THE INVENTION

1. Field of the Invention

The present invention relates to guidance systems for missiles or the like, and more particularly, to a means and method of coding a light beam projected from a missile firing position toward a target and received by a missile fired toward the target.

2. Description of the Prior Art

Beam rider missiles are known today which are guided by a laser beam pointed from a missile launching site to a target. The beam contains modulation signals which appear at a receiver in the missile and are decoded to form guidance commands for directing the missile basically along the centerline of the beam to intercept the target. U.S. Pat. No. 4,014,482 to Esker et al is one which discloses a rotating light chopper or reticle with opaque and transparent portions for coding or modulating the beam. The center of the reticle rotates around the center of the generated beam, with only a portion of the reticle intersecting the beam at any one time. The laser beam is pulsed at two different rates and coordinated with the reticle position to provide the missile receiver with magnitude and phase components to use in determining the missile position with respect to the beam centerline.

U.S. Pat. No. 3,957,377 to Hutchinson shows a similar system wherein a rotating reticle or disc comprises two separate patterns for providing yaw and pitch position data in the guided body, as respective portions of the reticle pass across the beam.

U.S. Pat. No. 3,711,046 to Barhydt et al discloses a missile guidance system wherein a source of infrared radiation at the missile produces a beam detected by a guidance unit at the sight position. A rotating reticle in the guidance unit has concentric bands of different width as the bands progress around the reticle, producing a sinusoidal modulation of the infrared image intercepted thereby.

Other prior art systems use various rotating disc patterns in target tracking applications. The U.S. Pat. No. 3,500,415 to Bishop and U.S. Pat. No. 3,002,097 to Nuut are examples of such. U.S. Pat. No. 2,931,912 to Macleish uses a scanning disk pattern which provides two signals indicating, respectively, the polar coordinates of the target.

These known systems are all relatively complicated and it is an object of the present invention to provide a guidance method for a beam riding missile or the like which is simpler than conventional methods. Another object is to provide, in a guidance system, a novel beam projection and coding means.

SUMMARY OF THE INVENTION

Briefly, our invention comprises a light beam generator and encoder including a rotating reticle through which the light beam passes. The reticle is centered at the beam centerline and carries one opaque area extending radially from the center to the periphery, the remainder of the reticle being transparent. The opaque area preferably has a "leaf" shape forming substantially a point at the outer edge of the reticle and having convex sides coming together at the center at a predetermined angle. The beam will be aligned toward a target and be received at the rear of a missile fired toward the target. Standard receiving means in the rear of the missile determines the position of the missile relative to the beam centerline and derives control signals for guiding the missile.

The rotating reticle pattern creates coded information at the missile from which the position of the missile in the beam is easily determined in polar coordinate form. The radial position of the missile from the beam center is determined by the dwell time of the opaque area. The angular position from a predetermined reference point is determined by the time measured beyond the reference point in each revolution to the occurrence of the opaque area, knowing of course the rotating rate of the reticle. The term "light" is obviously used herein in its broadest sense, including the infrared and ultraviolet for example.

DESCRIPTION OF THE PREFERRED EMBODIMENT

Figure 1:
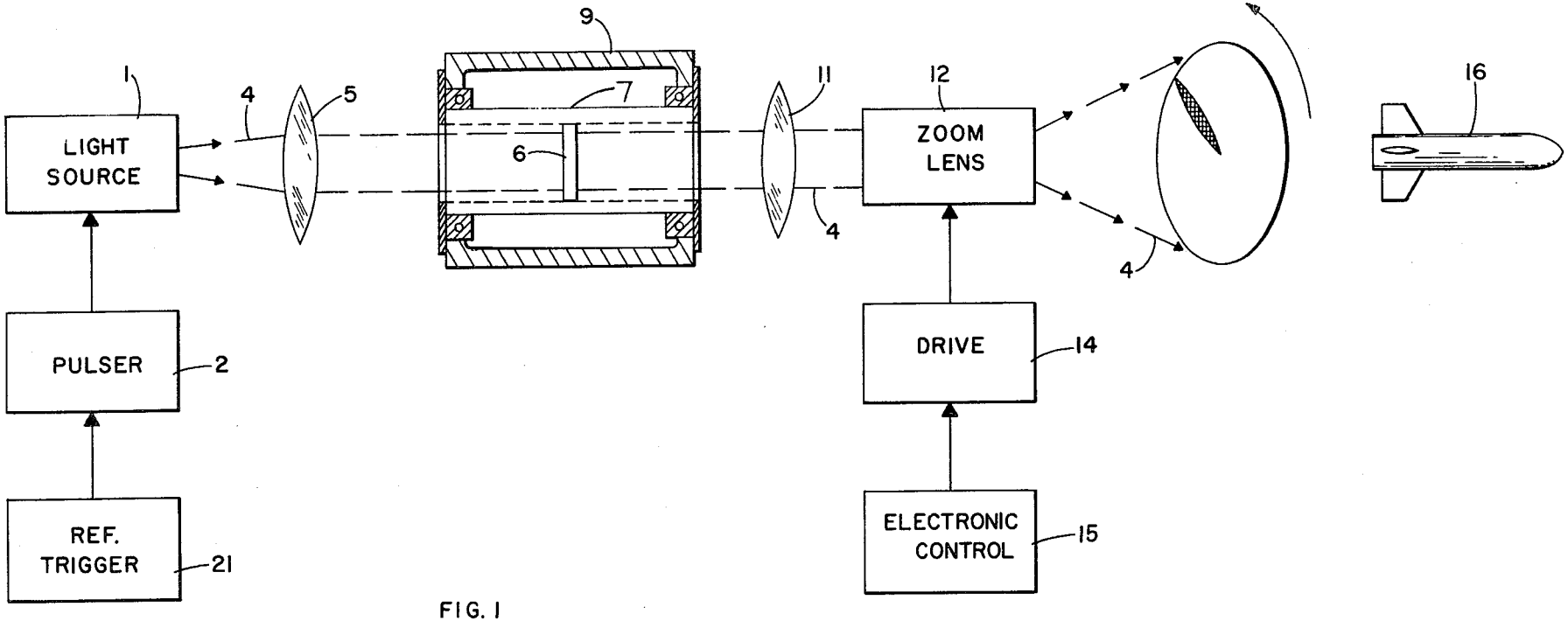
FIG. 1 is a schematic side view of the optical beam transmitting apparatus of the present invention, showing a missile in flight on line with the beam.

In FIG. 1, a light source 1 and beam projecting means are established at a sighting station. The light source 1 is preferably a laser such as a $CO_2$ laser, for example, but may be any suitable light energy, visible or invisible, and may be continuous or pulsed, as desired. An electronic pulser 2 is indicated to turn the light on and off at a desired rate for a purpose to be described later.

Light from source 1 is a beam 4 which passes through a collimating lens 5, if required, and then through an encoder which comprises a rotatable circular reticle 6. Means are provided for mounting the reticle 6 with its center on the beam centerline. In FIG. 1, the reticle 6 is shown mounted in the hollow rotor shaft 7 of an electric drive motor 9, for example. The reticle 6 is sized to be substantially filled or covered by the light beam 4. This is important in producing good signal strength.

The reticle 6 contains an opaque portion 10 (FIG. 2) extending generally radially from the center to the edge of the beam 4. The design and operation of this opaque portion 10 will be taken up in detail later. The remainder of the reticle 6 is transparent to the beam 4.

After passing through the reticle 6, beam 4 is shaped by further optics 11 as required and then enters a zoom lens assembly 12 before being projected toward a target (not shown). The zoom lens 12 is operated by a drive section 14 in accordance with signals from an electronic control 15. The zoom lens 12 is programmed to maintain the diameter of beam 4 essentially constant at the position of a missile 16 as the latter travels from launch to the target, and to maintain the reticle image substantially in focus at the missile. Such a program is of course tailored to fit the particular missile being used and is standard technology, such as described in U.S. Pat. No. 4,014,482 to Esker et al, for example. The beam diameter will be a matter of choice, but larger than the missile, of course.

Figure 2:
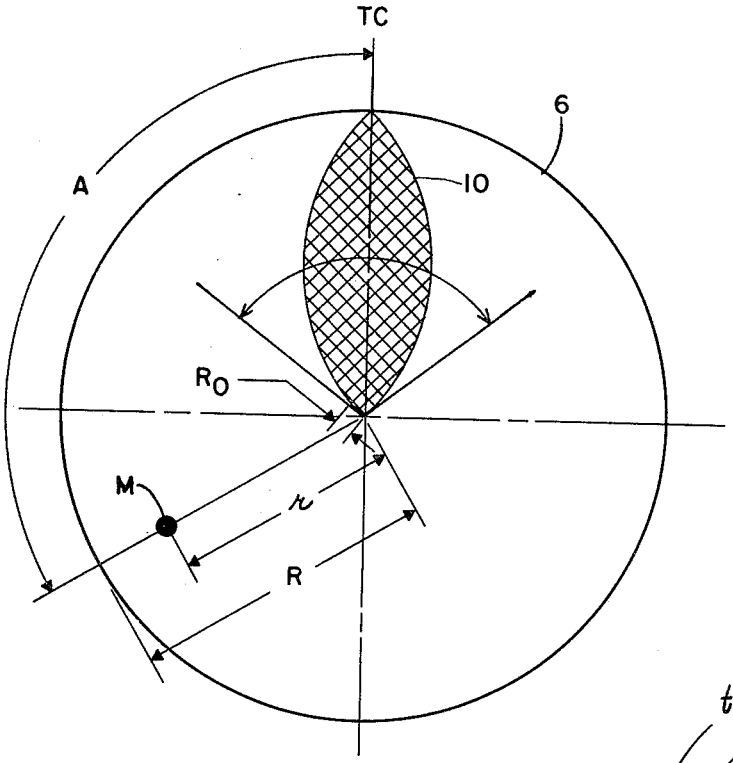
FIG. 2 is a face view of the preferred shape of reticle.

As shown in FIG. 2, the "leaf" shape of the opaque portion 10 is a preferred shape. It starts at the circumference as substantially a point, and its angular width increases linearly toward the center. Other shapes varying in angular width in the radial direction are obviously workable in principle, such as a rectangular shape, for example. However, such a shape would require more complex computations to determine the position error signals for the missile 16 to be guided. In FIG. 2, which also represents a view looking down the beam 4 from behind, a missile position is illustrated by the spot M, for example. Missile position M is located at a radius r from the beam centerline and at an angle A from the top center point of the beam. The beam radius is denoted as R. Thus, the quantities A and r define, in polar coordinates, the position of the missile 16 relative to the beam centerline which is also the sight line.

Figure 3A:
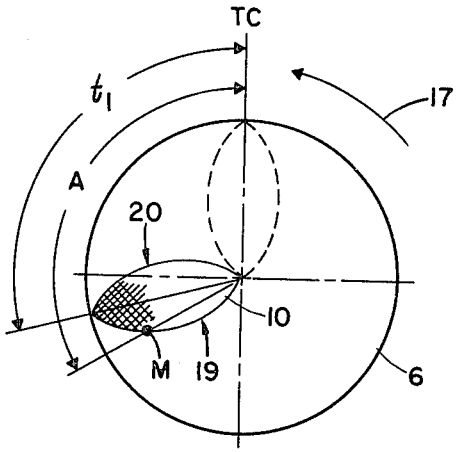
FIGS. 3*a*, 3*b*, and 3*c* are face views of the reticle representing down-range views of the projected light beam for a certain off-center position of the missile therein, at three significant rotated positions of the reticle.
Figure 3B:
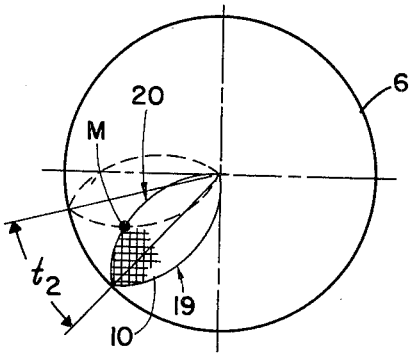
Figure 3C:
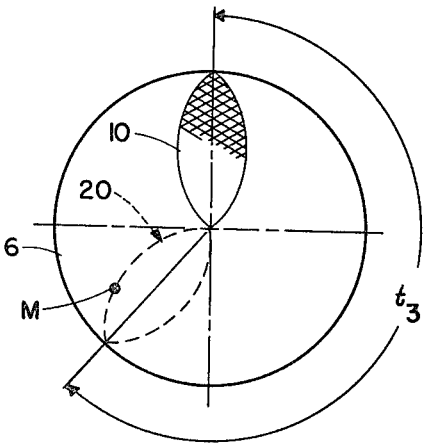

To explain the method for obtaining the quantities A and r, reference is now made to FIGS. 3*a* through 3*c*, showing three particular successive positions of the opaque portion as reticle 6 is rotated. It is seen that for a particular missile position M, with the reticle 6 rotating in the direction of arrow 17 in FIG. 3*a*, the light beam 4 will be visible to the missile 16 during time periods $t_1$ and $t_3$ but will be blocked from view during time period $t_2$. The latter is from the time the leading edge 19 of opaque portion 10 passes missile position M until the trailing edge 20 of opaque portion 10 passes missile position M. A light detector will therefore be provided at the missile together with further means for measuring these three time periods.

In order to identify the top center position TC to enable the measurement of the three time periods, the beam projector sends a special optical reference pulse signal or signals to indicate the instant when the center point of opaque portion 10 passes through the top center position of its rotation. This reference signal will be referred to later. If the light source 1 is of continuous energy content, the time period measurements will result in only one relatively large "off" and "on" light signal for each reticle revolution. Preferably, however, the light source 1 is pulsed at a given rate. The time periods $t_1$, $t_2$ and $t_3$ are then measured as the number of light pulses counted between the intervals when the beam 4 is blocked and unblocked by the opaque portion 10. In other words, $n_1$ represents the number of pulses counted during the time period $t_1$ shown in FIG. 3*a*, $n_2$ represents the number of pulses missing or blocked during the time period $t_2$ in FIG. 3*b*, and $n_3$ represents, in effect, $t_3$ in FIG. 3*c*.

In one example of reticle and system design, the laser light source 1 is pulsed at the rate of 5,000 pulses per second, while the reticle 6 is rotated 50 revolutions per second. This gives 100 light pulses per revolution of the reticle 6. The reticle opaque portion 10 is shaped to block one pulse at the outer edge of the reticle and is tapered such that the number of pulses blocked increases linearly as the radius decreases until a small minimum radius $R_O$ (FIG. 2) is reached, at which a constant 29% of the total pulses per revolution are blocked by the opaque portion 10 between $R_O$ and the center.

The coordinates A and r may be determined from the following equations:

$$r = \frac{(N_0 - N_R) - n_2}{N_0 - N_R}(R - R_0) + R_0 \quad (1)$$

where:

$N_0$=number of pulses blocked in the central region within $R_0$ $N_R$=number of pulses blocked at edge of beam R=radius of beam at the missile (held constant by zoom lens)

$R_0$=0.05R $$A = \frac{n_1 + .5n_2}{N}(360°) \quad (2)$$

where:

$N = n_1 + n_2 + n_3 = 100$ pulses/rev.

As mentioned previously, the top center position of the opaque portion 10 is signalled to the missile 16 by a reference pulse signal at the correct instant in time. This one light pulse will not be received if the missile is in a position "behind" the opaque portion 10 where all pulses are being blocked. Therefore another way of sending the reference signal information is preferred. Three reference pulses are repeatedly sent: one at the top center position (0° of rotation), one at 110° past top center, and one at 230° past top center. The different angular spacings between these reference pulses allows reception of any two of them to enable determination of the top center position. In a pulsed system as described herein, the reference pulses are sent by firing the proper laser pulse slightly ahead of its regular time, thus making the reference pulses slightly early, for example. A reference trigger 21 is shown controlling the pulser 2 in FIG. 1 to initiate the early pulses. The reference trigger 21 may be controlled by a position sensor (not shown) mounted at the rim of the reticle 6, for example. Standard early (or late) gate circuitry in the missile receiving electronics will detect these reference pulses.

It can be seen that at least two of the above three reference pulses can always be seen at the missile 16. This follows from the fact that, in the example given, the maximum angular width of the opaque portion 10 is only 105°.

Figure 4:
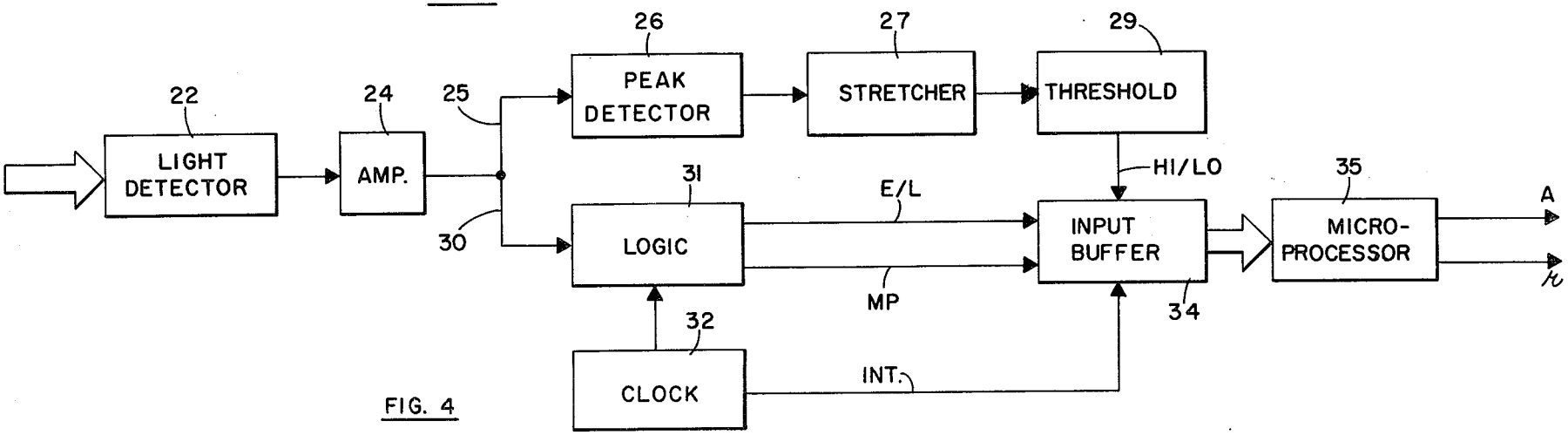
FIG. 4 is a block diagram of an illustrative receiver in the missile for deriving missile guidance signals from the beam.

FIG. 4 shows an example of a receiver in the missile 16 which might be used with the present system. Since this represents standard technology, the receiver need not be described in detail. To detect the light pulses of the receiver beam 4 and convert them to electrical pulses, a conventional infra-red detector 22, for example, is provided in the rear of missile 16. A spike voltage waveform is generated in a preamplifier 24 connected to detector 22.

A first output line 25 from preamplifier 24 is provided with a peak detector 26 followed by a pulse stretcher 27. The stretched voltage pulses are suitable for applying to a threshold device 29 for determining by comparision if the signal is actually to be treated as a pulse or "no pulse." The threshold device 29 is preferably of the dynamic, variable, type which is automatically adjusted based on the average level of incoming pulses. The output of threshold device 29 is therefore a HI/LO logic signal for handling by all-digital circuitry.

A second output line 30 from preamplifier 24 feeds to time decode logic 31 for determination if the incoming pulse spike is an "early/late" reference pulse to help determine the top center position TC of the opaque reticle portion 10. A "missing pulse" logic bit is also generated. The logic 31 is driven by clock pulses from a clock generator 32 which also supplies an "interrupt" pulse for the timing of subsequent process instructions.

The HI/LO signal, early/late signal E/L, missing pulse signal MP, and interrupt signal INT are all fed to an input buffer 34 for insertion in a digital microprocessor 35.

Figure 5:
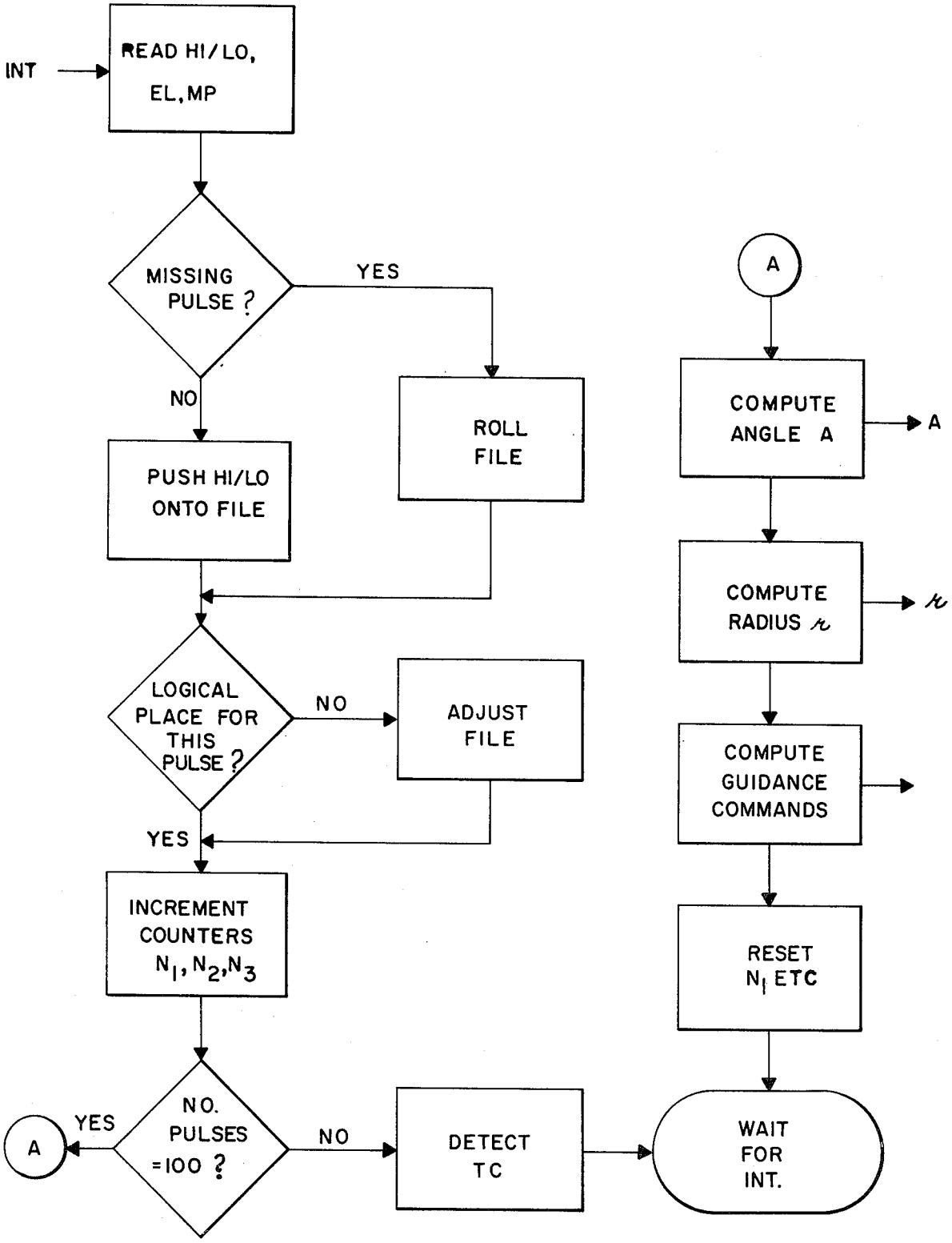
FIG. 5 is a sample brief flow chart illustrating the operation of the microprocessor of FIG. 4.

The function of microprocessor 35 as far as this invention is concerned, is to calculate the values of A and r for subsequent generation of error and guidance signals to the flight control system of the missile 16. The quantities A and r may be evaluated according to equations (1) and (2) given previously. This processing technology is of course well known. A very basic flow chart for the operation of microprocessor 35 is given in FIG. 5, for example only. One interrupt pulse for each laser signal pulse initiates each processor operational step. The quantities A and r are computed once every 100 laser pulses in this case (once per revolution of reticle 6).

While the present specification has referred to the measurement of polar type coordinates, these quantities may be transformed into rectangular coordinates for more convenient use with a typical aircraft type of control system, if desired, by employing the standard transformation formulas $$x = r \cos A$$

$$y = r \sin A$$

While in order to comply with the statute, the invention has been described in language more or less specific as to structural features, it is to be understood that the invention is not limited to the specific features shown, but that the means and construction herein disclosed comprise the preferred mode of putting the invention into effect, and the invention is therefore claimed in any of its forms or modifications within the legitimate and valid scope of the appended claims.

We claim:

1. An optical beam navigation system for determining the position of an object relative to a beam centerline, comprising:

a reticle rotating about a center of rotation coincident with the beam centerline, the reticle having first and second regions of which one region is transparent and the other region is opaque, the first region having leading and trailing boundaries which are symmetrical about a line extending radially from the reticle's center of rotation, and the first region having an angular width between the leading and trailing boundaries which varies progressively as a function of the radial distance from the center of rotation;

an optical beam projector for projecting a light beam through the reticle and along the beam centerline to the object and for maintaining an optical image of the reticle in focus near the object;

an optical receiver, positioned at the object, including means for measuring the two respective angular positions of the rotating reticle when the images of the leading and trailing boundaries pass over the object and means for determining the midpoint of said two measured angular positions, whereby the midpoint indicates the angular position of the object.

2. Apparatus in accordance with claim 1 wherein said angular width varies linearly with the radius.

3. Apparatus in accordance with claim 1 wherein said angular width increases as said radius decreases.

4. Apparatus in accordance with claim 1 wherein said angular width increases from substantially zero degrees at the reticle's outer edge to no greater than 120 degrees near the reticle's center of rotation.

5. Apparatus in accordance with claim 1 including zoom lens means for maintaining the diameter of said optical image substantially constant at said object.

6. Apparatus in accordance with claim 1 including means for pulsing said light beam at a normally constant rate.

7. Apparatus in accordance with claim 1 wherein said reticle has substantially the same area as the cross section of said beam passing through it, whereby said beam essentially fills the area of said reticle.

8. Apparatus in accordance with claim 1 including means producing a reference signal in said light beam for indicating when the center of said opaque portion is coincident with the top center of said beam.

9. Apparatus in accordance with claim 8 wherein said reference signal means comprises means generating at least two reference light pulses per revolution of said reticle, said reference pulses being spaced unequally at predetermined angular locations around the periphery of said beam relative to the top center thereof.

10. A navigation system according to claim 1, wherein:

the object is a vehicle being guided to travel along the beam centerline.

11. Apparatus in accordance with claim 1 wherein said reticle is circular and mounted in a hollow rotor shaft of a motor, said motor being positioned with the center of rotation of said reticle coincident with the centerline of said beam.

12. Apparatus in accordance with claim 1 including means for pulsing said light beam to produce a constant number of light pulses per revolution of said reticle at a normally constant pulse rate, and means for causing at least two of said pulses per revolution to occur at a slightly different time spot from normal, as reference pulses, said reference pulses being spaced unequally at predetermined angular locations around the periphery of said beam relative to the top center thereof.

13. An optical beam navigation system for determining the position of an object relative to a beam centerline, comprising:

a reticle rotating about a center of rotation coincident with the beam centerline, the reticle having an opaque region and a transparent region, the opaque region extending generally radially from the center of rotation and having an angular width which varies progressively as a function of the radial distance from the center of rotation;

an optical beam projector for projecting a light beam through the reticle and along the beam centerline to the object and for maintaining an optical image of the reticle in focus near the object; and means for producing a reference signal in said light beam each time the rotating reticle assumes any of at least three predetermined, unequally spaced angular positions;

wherein the angular width of the reticle's transparent region, at any radial distance from the reticle's center of rotation, is large enough so that the object receives at least two of the reference signals during each complete rotation of the reticle.

14. Apparatus in accordance with claim 13 wherein said receiver further includes means for determining the angular and radial distance of said receiver from the beam centerline in accordance with the observed position and angular width, respectively, of said first region of the reticle.

15. A navigation system according to claim 13. wherein:

the object is a vehicle being guided to travel along the beam centerline.

16. Apparatus in accordance with claim 13 including means for pulsing said light beam at a normally constant rate.

* * * * *